US006373233B2

(12) United States Patent
Bakker et al.

(10) Patent No.: US 6,373,233 B2
(45) Date of Patent: Apr. 16, 2002

(54) LOW-DROPOUT VOLTAGE REGULATOR WITH IMPROVED STABILITY FOR ALL CAPACITIVE LOADS

(75) Inventors: Anthonius Bakker, Phoenix, AZ (US); Klaas-Jan de Langen, Sunnyvale, CA (US)

(73) Assignee: Philips Electronics No. America Corp., New York, NY (US)

( * ) Notice: Subject to any disclaimer, the term of this patent is extended or adjusted under 35 U.S.C. 154(b) by 0 days.

(21) Appl. No.: 09/748,295

(22) Filed: Dec. 21, 2000

Related U.S. Application Data

(60) Provisional application No. 60/218,773, filed on Jul. 17, 2000.

(51) Int. Cl.[7] ..... G05F 1/40

(52) U.S. Cl. ..... 323/282

(58) Field of Search ..... 323/268, 271, 323/275, 280, 282, 285

(56) References Cited

U.S. PATENT DOCUMENTS

| | | | | |
|---|---|---|---|---|
| 4,543,522 A | * | 9/1985 | Moreau | 323/303 |
| 5,274,323 A | * | 12/1993 | Dobkin et al. | 323/280 |
| 5,736,843 A | * | 4/1998 | Amin | 323/273 |
| 6,198,266 B1 | * | 3/2001 | Mercer | 323/316 |
| 6,246,221 B1 | * | 6/2001 | Xi | 323/280 |

OTHER PUBLICATIONS

IEEE journal of Solid–State Circuits; Richard J. Reay and Gregory T.A. Kovacs, An Unconditionally Stable Two–Stage CMOS Amplifier, 1995.

* cited by examiner

*Primary Examiner*—Matthew Nguyen
(74) *Attorney, Agent, or Firm*—Harold Tsiang

(57) ABSTRACT

The present invention provides an LDO that is stable for all capacitive loads. Because the LDO is stable for all capacitive loads, the ESR (equivalent series resistance) inherent in any capacitive load can no longer affect the equivalent value of the combination of the ESR and the capacitive load. Thus, the invention also effectively removes the ESR restrictions on the loads. According to the present invention, a low dropout voltage regulator is provided. The regulator comprises a switching element (e.g., a transistor) having first terminal for receiving an input signal, a second terminal for providing an output signal and a control terminal; a control circuit, operably coupled to the switching element, that is configured to control the switching element; and a compensation circuit having a first segment connected between the first and control terminals of the switching element and a second segment connected between the control and second terminals of the switching element. The first segment of the compensation circuit includes a first resistor and the second segment of the compensation circuit includes a RC circuit. In one embodiment of the invention, the RC circuit includes a second resistor and a capacitor connected to each other in series. In another embodiment of the invention, the RC circuit includes a distributed RC network having a plurality of resistors and capacitors.

10 Claims, 4 Drawing Sheets

LOW-DROPOUT VOLTAGE REGULATOR WITH IMPROVED STABILITY FOR ALL CAPACITIVE LOADS

This application claims the benefit of U.S. Provisional Application No. 60/218,773, filed on Jul. 17, 2000.

BACKGROUND OF THE INVENTION

The present invention relates to the field of electronics, and in particular to low-dropout voltage regulators.

Low-dropout voltage regulators have been used for battery applications, e.g., in cellular phones, etc. FIG. 1 shows a conventional low-dropout regulator (LDO) 10 that is connected to a load 20. LDO 10 includes an op-amp 12, a PMOS transistor M1, resistors R1 and R2, and a reference voltage supply Vref. Load 20 includes a resistive load RL and a capacitive load CL. A very serious problem associated with this circuit is that it is not stable for all capacitive loads (CL). Known solutions can stabilize this circuit for values of CL larger than approximately 1 uF. Another restriction associated with this circuit is that the capacitor must have a low and very well-defined equivalent series resistance (ESR), which is inherent in any capacitive loads. Examples of such LDO's are Maxim's MAX8863, Telcom's TC1072, Linear's LT1121, which are available from Maxim Integrated Products, Inc., Telcom Semiconductors, Inc. and Linear Technology Corporation, respectively.

Therefore, there is a need for an improved low-dropout voltage regulator that is suitable for all capacitive loads and that removes the ESR restrictions on the loads.

SUMMARY OF THE INVENTION

The present invention provides an LDO that is stable for all capacitive loads. Because the LDO is stable for all capacitive loads, the ESR can no longer affect the equivalent value of the combination of the ESR and the capacitive load. Thus, the invention also effectively removes the ESR restrictions on the loads.

According to the present invention, a low dropout voltage regulator is provided. The regulator comprises a switching element (e.g., a transistor) having first terminal for receiving an input signal, a second terminal for providing an output signal and a control terminal; a control circuit, operably coupled to the switching element, that is configured to control the switching element; and a compensation circuit having a first segment connected between the first and control terminals of the switching element and a second segment connected between the control and second terminals of the switching element.

According to the invention, the first segment of the compensation circuit includes a first resistor and the second segment of the compensation circuit includes a RC circuit. In one embodiment of the invention, the RC circuit includes a second resistor and a capacitor connected to each other in series. In another embodiment of the invention, the RC circuit includes a distributed RC network having a plurality of resistors and capacitors.

According to the invention, the control circuit includes an operational amplifier having an output terminal connected to the control terminal of the switching element, and a pair of resistors connected in series between the second terminal of the switching element and a first voltage reference level. The amplifier of the control circuit has a positive terminal connected between the pair of resistors and a negative terminal connected to a second voltage reference level.

Other objects and attainments together with a fuller understanding of the invention will become apparent and appreciated by referring to the following description and claims taken in conjunction with the accompanying drawings.

BRIEF DESCRIPTION OF THE DRAWINGS

The invention is explained in further detail, and by way of example, with reference to the accompanying drawings wherein.

Throughout the drawings, the same reference numerals indicate similar or corresponding features or functions.

DETAILED DESCRIPTION OF THE PREFERRED EMBODIMENTS

Figure 1:
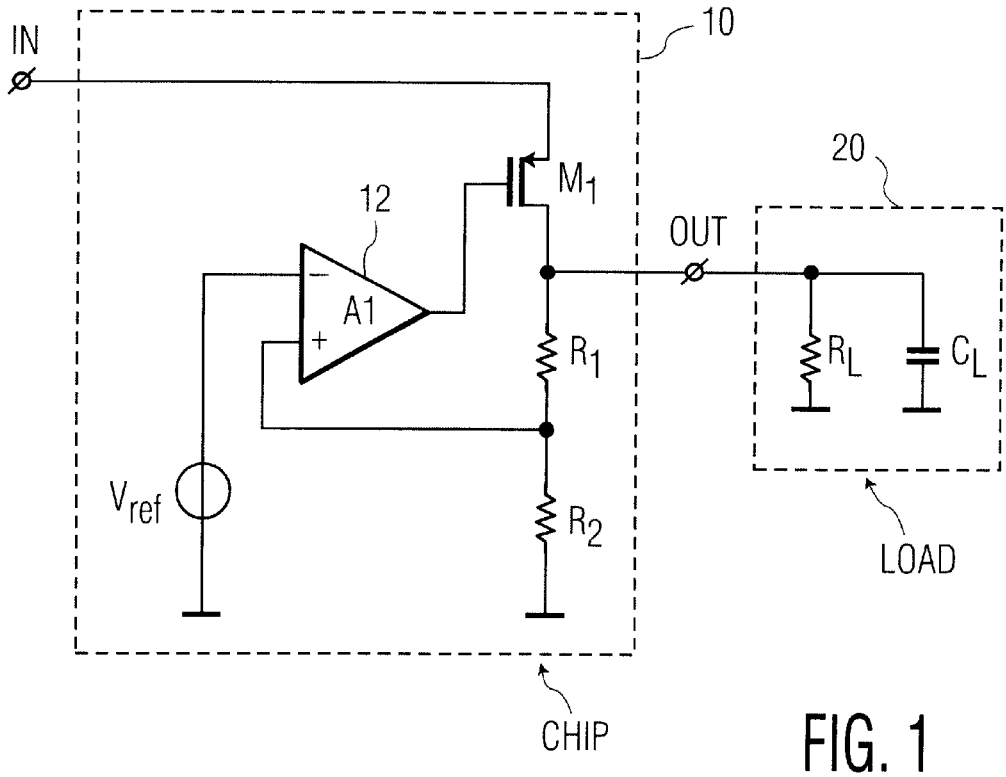
FIG. 1 (PRIOR ART)
FIG. 1 shows a conventional low-dropout regulator.
Figure 2A:
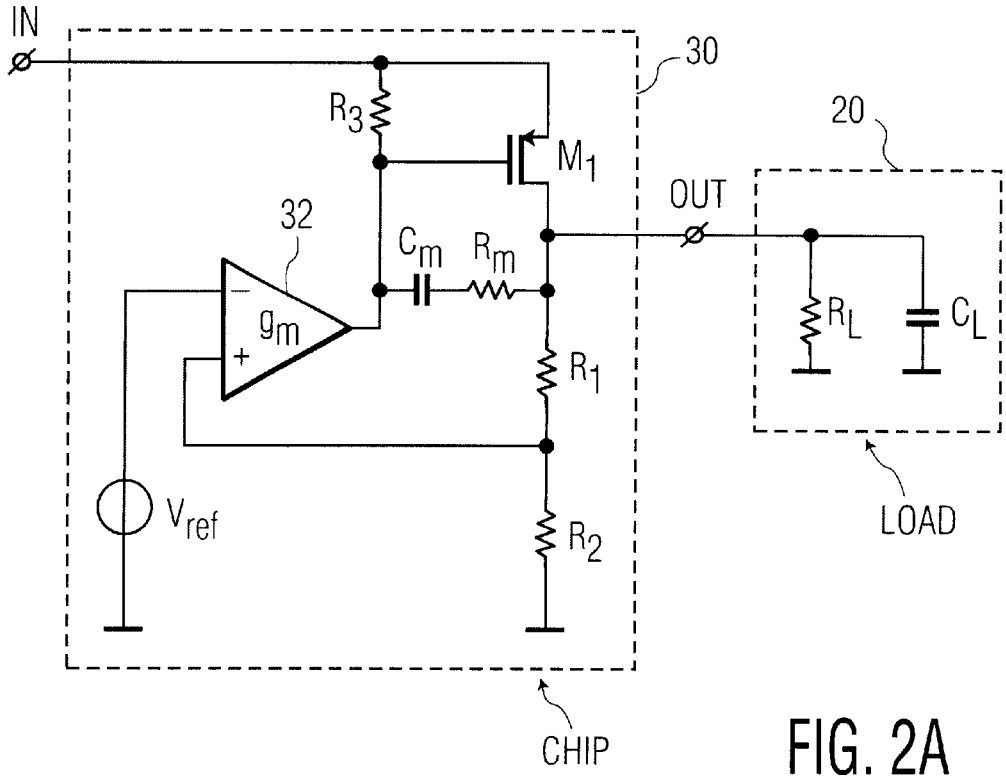
FIG. 2A shows an LDO according to a first embodiment of the present invention.

FIG. 2A shows an LDO 30 according to a first embodiment of the present invention. LDO 30 includes an op-amp 32 having a gain of gm, a PMOS transistor M1, resistors R1, R2, R3 and Rm, and a Miller compensation capacitor Cm. Op-amp 32 has a negative terminal connected to a reference voltage Vref, a positive terminal connected between resistors R1 and R2, and an output terminal connected to the gate terminal of transistor M1. Resistor R3 is connected between the source terminal of transistor M1 (which is also an input of LDO 30) and the gate terminal of transistor M1. Capacitor Cm and resistor Rm are connected together in series between the gate terminal of transistor M1 and the drain terminal of transistor M1. Capacitor Cm and resistor Rm add a zero in a zero-pole plot. Resistors R1 and R2 are connected together in series between the drain terminal of transistor M1 and the ground level. The output of LDO 30 is connected to load 20.

Figure 2B:
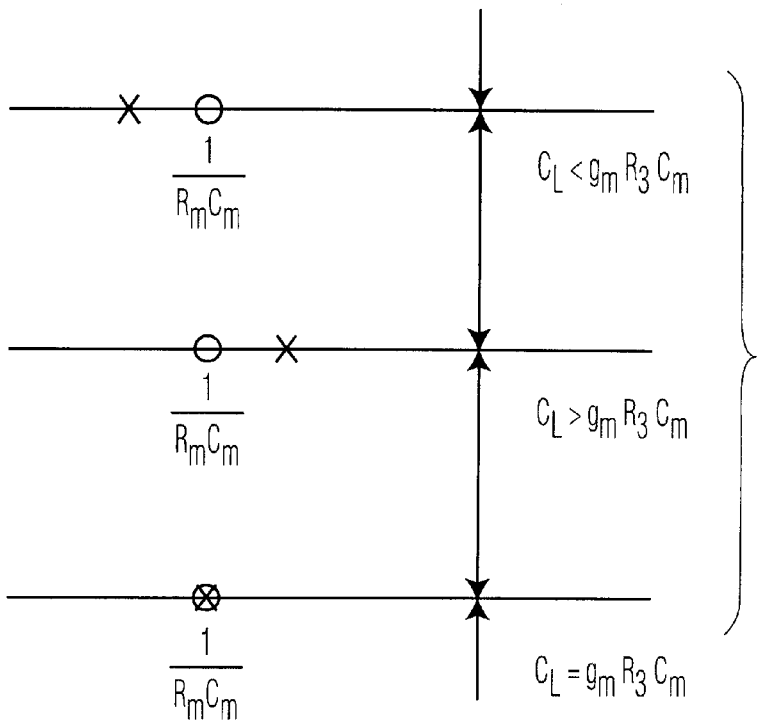
FIG. 2B are graphs showing the zeroes and poles of the circuit in FIG. 2A, where Rm is not equal to zero.

FIG. 2B are graphs showing the zeroes and poles under different load conditions for the circuit in FIG. 2A, where Rm is not equal to zero.

Figure 3:
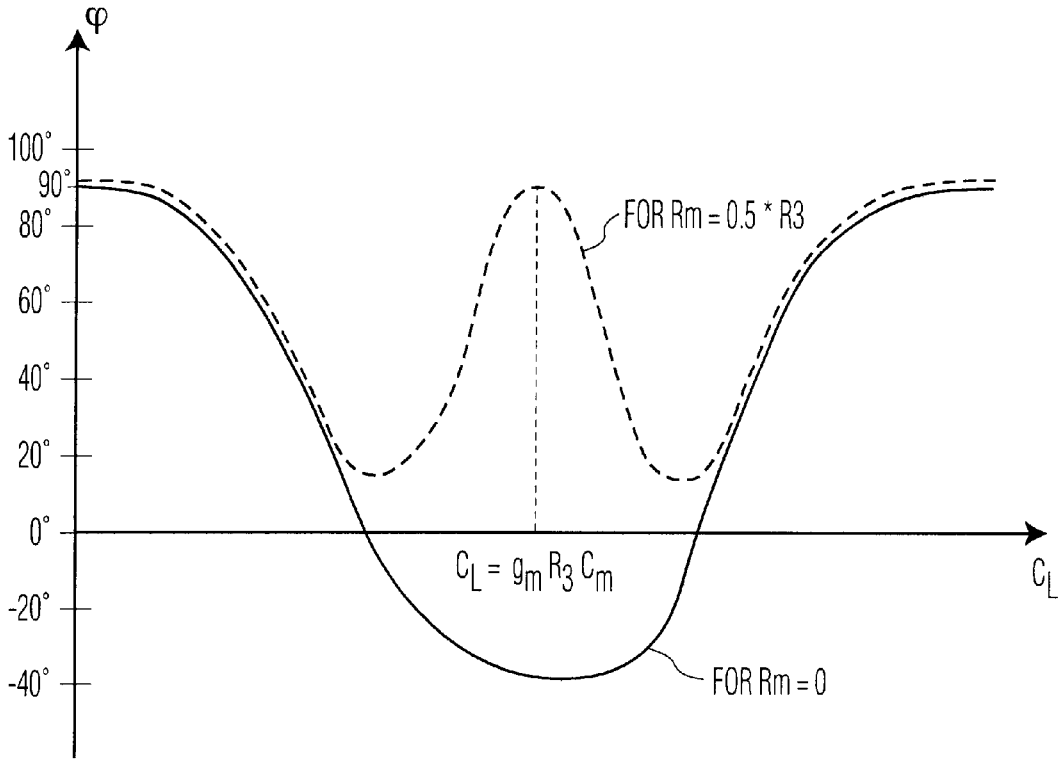
FIG. 3 shows the phase margin values of the LDO in FIG. 2A as a function of the capacitive load.

FIG. 3 shows both a solid line and a dash line. The solid line shows the phase margin $\phi$ of LDO 30 in FIG. 2A as a function of CL, where Rm=0 ohm. The phase margin plot is for the open loop of the amplifier in the LDO. The phase margin of the closed loop of the amplifier is zero. In FIG. 3, a positive phase margin implies stability, while negative values indicate oscillation. Most LDO applications need a phase margin of 40 degrees or more to operate in a stable condition. For Rm=0 ohm, the solid line shows that the phase margin (p is positive only for very small and very large values of CL. See "An Unconditionally Stable Two-Stage CMOS Amplifier," IEEE Journal of Solid-State Circuits, Vol. 30, No. 5, May 1995, by Richard J. Reay and Gregory T. A. Kovacs, which is hereby incorporated by reference. The value of Rm can be chosen in such a way that the phase margin is improved in the middle of the CL range, e.g., when Rm=0.5*R3.

In FIG. 3, the dash line shows the phase margin $\phi$ of LDO 30 as a function of CL, where Rm≠0 and Rm=0.5*R3. On the dash line, when the phase margin $\phi$ is at a maximum value, CL=($g_m$)*(R3)*(Cm). The dash line shows that LDO 30 will become stable for all values of CL, because all phase margin values are greater than zero. However, for certain values of CL, the phase margin may be close to zero, which may not be desirable for certain applications.

Figure 4A:
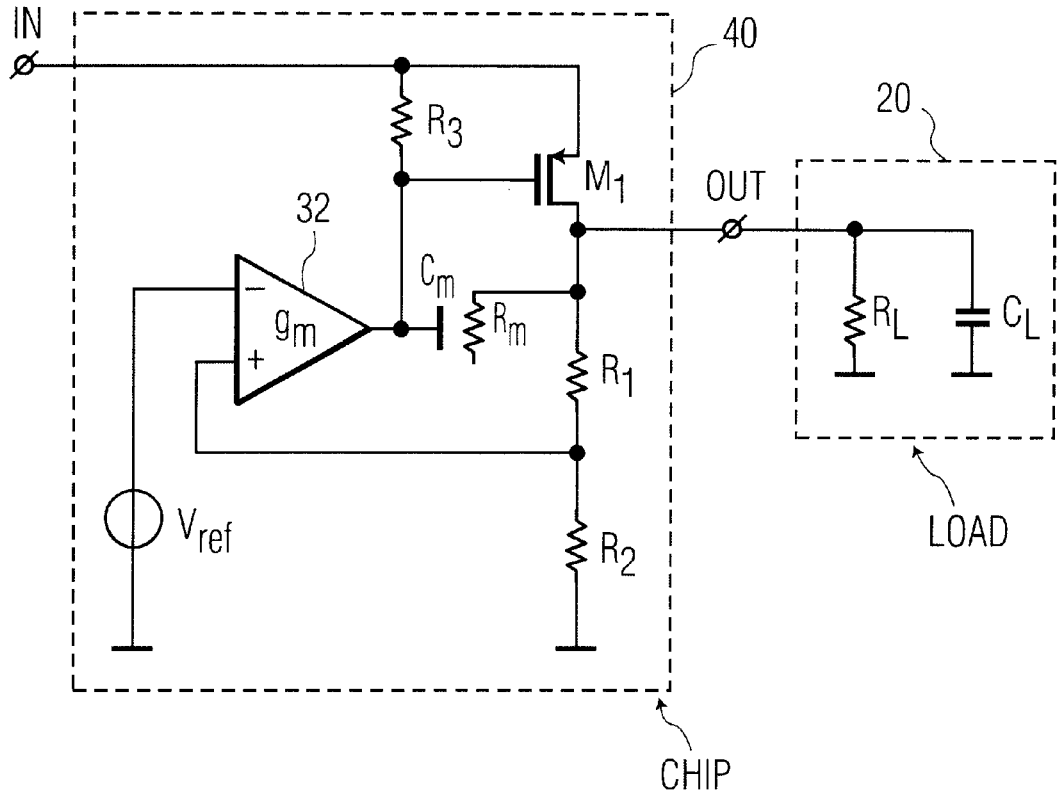
FIG. 4A shows an LDO according to a second embodiment of the present invention.
Figure 4B:
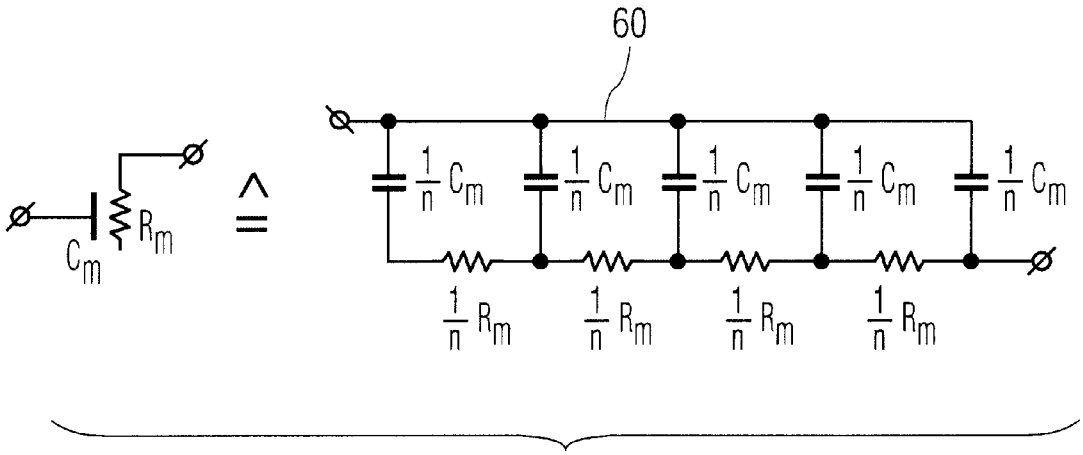
FIG. 4B shows an equivalent RC network of the distributed combination of Rm and Cm used in FIG. 4A.

FIG. 4A shows an LDO 40 according to a second embodiment of the present invention, with a distributed combination of Rm and Cm. This embodiment is similar to the first embodiment in FIG. 2A, except that it uses the distributed Rm and Cm. FIG. 4B shows an equivalent RC network 60 of the Rm and Cm combination used in FIG. 4A. RC network 60 includes n resistors each having a value of (1/n)(Rm) and n capacitors each having a value of (1/n)(Cm). The sum of the n resistors is Rm, and the sum of the n capacitors is Cm. Furthermore, the total size of the RC network remains the same as that of the combination of the Rm and Cm.

Figure 4C:
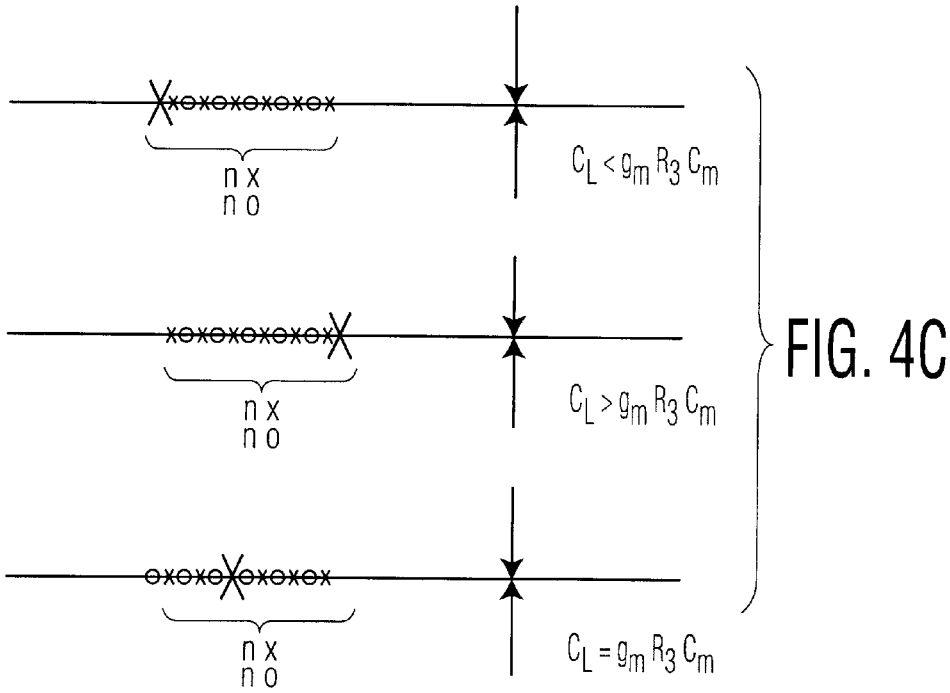
FIG. 4C are the graphs showing the zeroes and poles of the circuit in FIG. 4A.

The second embodiment of the invention has an advantage that the zeroes and corresponding poles are distributed over a certain range, as shown in the graphs in FIG. 4C for different values of CL. The number of the zeroes are one more than the number of the poles. In FIG. 4C, the big "X"s correspond to the poles in FIG. 2B and are present in FIG. 4C only for comparison purposes.

Figure 5:
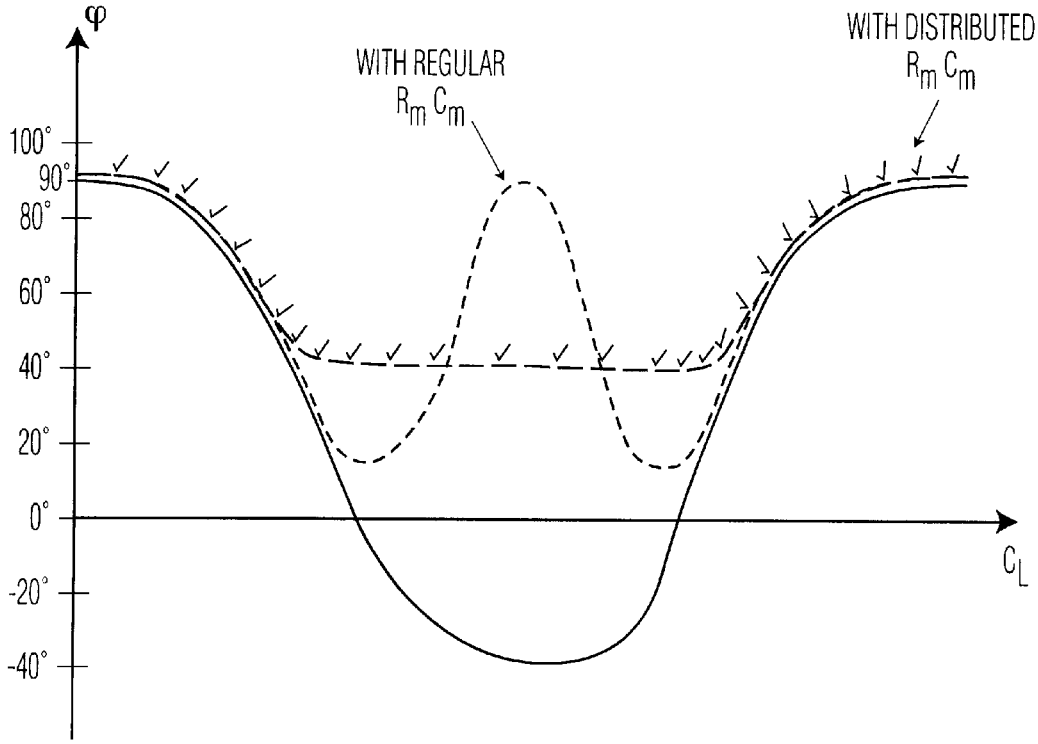
FIG. 5 shows the phase margin values of the LDO in FIG. 4A as a function of the capacitive load.

The advantage of the distributed zeroes and the corresponding poles is evident in FIG. 5, which shows the phase margin values of LDO 40 of the second embodiment overlaying the graphs in FIG. 3. As shown in FIG. 5, the phase margin of LDO 40 is now at least 45 degrees for the entire range of CL. This makes LDO 40 suitable for any capacitive load.

Because the invention provides stable LDOs for all capacitive loads, the ESR can no longer affect the equivalent value of the combination of the ESR and CL. Thus, the invention effectively removes the ESR restrictions on the loads.

It should be noted that although a PMOS transistor M1 is shown in the above figures, a pnp bipolar transistor may also be used instead.

While the invention has been described in conjunction with specific embodiments, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A low dropout voltage regulator, comprising:

a switching element having first terminal for receiving an input signal, a second terminal for providing an output signal and a control terminal;

a control circuit, operably coupled to the switching element, that is configured to control the switching element; and a compensation circuit having a first segment connected between the first and control terminals of the switching element and a second segment connected between the control and second terminals of the switching element;

wherein the first segment of the compensation circuit includes a first resistor and the second segment of the compensation circuit includes a RC circuit.

2. The regulator of claim 1, wherein the RC circuit includes a second resistor and a capacitor connected to each other in series.

3. The regulator of claim 1, wherein the RC circuit includes a distributed RC network having a plurality of resistors and capacitors.

4. The regulator of claim 1 wherein the switching element is a MOS transistor, and the first, second and control terminals of the switching element are source, drain and gate terminals of the MOS transistor.

5. The regulator of claim 1, wherein the control circuit includes an operational amplifier having an output terminal connected to the control terminal of the switching element.

6. The regulator of claim 5, wherein the control circuit further includes a pair of resistors connected in series between the second terminal of the switching element and a first voltage reference level, and wherein the amplifier of the control circuit has a positive terminal connected between the pair of resistors and a negative terminal connected to a second voltage reference level.

7. A low dropout voltage regulator, comprising:

a transistor having a source terminal for receiving an input signal, a drain terminal for providing an output signal and a gate terminal;

a control circuit, operably coupled to the transistor, that is configured to control the transistor, the control circuit including an operational amplifier having an output terminal connected to the gate terminal of the transistor; and a compensation circuit having a first resistor connected between the source and gate terminals of the transistor and a RC circuit connected between the gate and drain terminals of the transistor.

8. The regulator of claim 7, wherein the RC circuit includes a second resistor and a capacitor connected to each other in series.

9. The regulator of claim 7, wherein the RC circuit includes a distributed RC network having a plurality of resistors and capacitors.

10. The regulator of claim 7, wherein the control circuit further includes a pair of resistors connected in series between the drain terminal of the transistor and a ground level, and wherein the amplifier of the control circuit has a positive terminal connected between the pair of resistors and a negative terminal connected to a voltage reference level.

* * * * *